US010240364B2

(12) United States Patent
Wehr

(10) Patent No.: US 10,240,364 B2
(45) Date of Patent: Mar. 26, 2019

(54) KEY OR KEY BLANK FOR A DISK CYLINDER AND ASSOCIATED DISK CYLINDER

(71) Applicant: ABUS August Bremicker Söhne KG, Wetter-Volmarstein (DE)

(72) Inventor: Michel Wehr, Willingen (DE)

(73) Assignee: ABUS August Bremicker Söhne KG, Wetter-Volmarstein (DE)

( * ) Notice: Subject to any disclaimer, the term of this patent is extended or adjusted under 35 U.S.C. 154(b) by 0 days.

(21) Appl. No.: 15/664,018

(22) Filed: Jul. 31, 2017

(65) Prior Publication Data

US 2018/0030758 A1 Feb. 1, 2018

(30) Foreign Application Priority Data

Aug. 1, 2016 (DE) ..... 10 2016 114 220

(51) Int. Cl.
*E05B 29/00* (2006.01)
*E05B 19/00* (2006.01)
*E05B 21/06* (2006.01)

(52) U.S. Cl.
CPC ..... *E05B 29/0013* (2013.01); *E05B 19/0041* (2013.01); *E05B 21/066* (2013.01); *E05B 29/0066* (2013.01)

(58) Field of Classification Search
CPC ..... E05B 19/0041; E05B 21/066; E05B 29/0066; E05B 29/0013; E05B 19/0052; E05B 19/0058; E05B 19/0064
USPC ..... 70/366, 409, 365, 377, 405–407, 492, 70/495
See application file for complete search history.

(56) References Cited

U.S. PATENT DOCUMENTS 1,789,757 A * 1/1931 Jacobi ..... E05B 17/0062 29/413
3,861,181 A * 1/1975 Needham ..... E05B 29/00 70/377
3,928,992 A * 12/1975 Talbot ..... E05B 29/0013 70/276
4,838,055 A * 6/1989 Gallagher ..... E05B 5/003 70/208

(Continued)

FOREIGN PATENT DOCUMENTS

CN 2079640 U 6/1991
CN 200949337 Y 9/2007

(Continued)

OTHER PUBLICATIONS

International Search Report corresponding to EP17183357, dated Nov. 24, 2017, 2 pages.

*Primary Examiner* — Lloyd A Gall
(74) *Attorney, Agent, or Firm* — Harness, Dickey & Pierce, P.L.C.

(57) ABSTRACT

A key or a key blank for a disk cylinder having a plurality of rotatably supported disk tumblers has a key shaft having a shaft cross-section that comprises a first end section, a second end section and a connection section along a longitudinal axis, the connection section connecting the first end section and the second end section to one another. The connection section is narrower than the two end sections and has two longitudinal edges that are aligned in parallel with one another and that extend obliquely to the longitudinal axis of the shaft cross-section between the two end sections.

18 Claims, 4 Drawing Sheets

(56) References Cited

U.S. PATENT DOCUMENTS

| | | | | |
|---|---|---|---|---|
| 5,490,405 | A | 2/1996 | Ramo et al. | |
| 6,799,447 | B2 | 10/2004 | Mielonen et al. | |
| 6,854,305 | B2 * | 2/2005 | Hurskainen | E05B 47/0653 70/278.3 |
| 8,689,595 | B2 * | 4/2014 | Martikainen | E05B 19/0017 70/366 |
| 2006/0150695 | A1 * | 7/2006 | Mielonen | E05B 9/04 70/366 |
| 2013/0067972 | A1 * | 3/2013 | Buhl | E05B 21/066 70/366 |

FOREIGN PATENT DOCUMENTS

| | | | |
|---|---|---|---|
| DE | 2817966 | A1 | 1/1979 |
| DE | 102011015314 | A1 | 10/2012 |
| EP | 0712979 | B1 | 2/2000 |
| GB | 1355188 | A | 6/1974 |
| NL | 7012705 | A | 2/1972 |
| WO | WO-2007147934 | A1 | 12/2007 |
| WO | WO-2013121114 | A1 | 8/2013 |

* cited by examiner

KEY OR KEY BLANK FOR A DISK CYLINDER AND ASSOCIATED DISK CYLINDER

The present invention relates to a key or to a key blank for a lock cylinder of the type of a disk cylinder. Such a key blank is provided to produce a key for a disk cylinder by applying a plurality of axially mutually displaced incisions—as explained in the following. The invention further relates to such a disk cylinder.

Such a disk cylinder comprises a cylinder housing, a cylinder core that is rotatably supported about a cylinder axis in the cylinder housing and that is also called a disk housing in this context, and at least one blocking pin that is provided at the outer periphery of the disk housing, that is aligned in parallel with the cylinder axis and is displaceable radially to the cylinder axis, and that blocks the disk housing against a rotational movement in a radially outer blocking position and release the disk housing for a rotational movement in a radially inner release position. Such a disk cylinder furthermore comprises a plurality of disk tumblers arranged along the cylinder axis in the disk housing and rotatably supported between a locked position and an unlocked position, wherein each disk tumbler has a key reception opening and has at least one blocking cut-out at the outer periphery in which the blocking pin can be at least partly received in the release position. The blocking pin can only be displaced into the release position when all the disk tumblers are in their unlocked position in which the blocking cut-out of the respective disk tumbler is aligned radially to the blocking pin.

Such a disk cylinder is known from DE 10 2011 015 314 A1 and from EP 0 712 979 B1.

In accordance with FIGS. 1 and 2, a disk cylinder 10 can have a cylinder housing 12 and a cylinder core 14 rotatably supported about a cylinder axis Z in the cylinder housing 14. The rotational movement of the disk housing 14 can be transmitted to a locking mechanism of a lock, not shown, via a coupling section 30 connected to the disk housing 14 to unlock or to lock the lock by means of the disk cylinder 10.

A plurality of rotatable disk tumblers 16, that are also called tumbler disks, are received after one another behind a securing disk 15 along the cylinder axis Z in the disk housing 14. The disk tumblers 16 have respective central reception openings 18 which together form a keyway 28 for inserting a key 24 and which have a rectangular cross-section in the example shown. The disk tumblers 16 furthermore have respective peripheral cut-outs in the form of blocking cut-outs 20 for receiving a common blocking pin 22 which is aligned in parallel with the cylinder axis Z.

The blocking pin 22 is radially movably received in a slit 32 provided in the wall of the disk housing 14. When the disk cylinder 10 is in its closed position and the disk tumblers 16 are thus rotated into their locked position, the blocking pin 22 adopts a radially outer blocking position. In this blocking position, a part section of the blocking pin 22 engages into a blocking pin reception recess 34 provided at the inner wall of the cylinder housing 12 so that the disk housing 14 is blocked (apart from a slight rotational clearance) against a rotational movement relative to the cylinder housing 12.

The disk tumblers 16 can be moved from their locked position into an unlocked position by means of the key 24. When all the disk tumblers 16 are in a so-called end sorting position which lies between the locked position and the unlocked position, the blocking cut-outs 20 of all the disk tumblers 16 are oriented in alignment with one another and radial to the blocking pin 22 viewed in the direction of the cylinder axis Z. The blocking pin 22 can hereby be displaced radially into its release position in which it is located outside the blocking pin reception recess 34 of the cylinder housing 12. The disk housing 14 is thereby released for a rotational movement relative to the cylinder housing 12 and the disk housing 14 can be rotated further in the unlocked direction together with the disk tumblers 16 until the unlocked position is reached.

A fixing cut-out 44 for receiving a core pin 46 can furthermore be provided at the outer periphery of each disk tumbler 16. The core pin 46 is aligned in parallel with the cylinder axis Z and is radially movably received in a slit provided in the wall of the disk housing 14. In the closed position of the disk cylinder 10, the core pin 46 engages into the fixing cut-outs 44 of the disk tumblers 16 and thus prevents a rotation of the disk tumblers 16 with respect to one another when no key 24 is inserted.

The key 24 associated with the disk cylinder 10 has—starting from a corresponding key blank—a plurality of differently angled incisions 26 along the key axis S at the key shaft 25 that correspond to the different angular positions of the blocking cut-outs 20 of the disk tumblers 16. After the insertion into the keyway 28, the key 24 first adopts a so-called starting position from where the key 24 can be rotated in the unlocked direction. By rotating the key 24 out of the starting position in the unlatched direction, the key 24 first moves into a so-called zero position in which the core pin 46 can move out of engagement with the fixing cut-outs 44 of the disk tumblers 16 and the disk tumblers 16 are thus released for a rotational movement relative to the disk housing 14 to be able to bring the blocking cut-outs 20 of the disk tumblers 16 into alignment after one another (so-called sorting).

The disk tumblers 16 have a specific rotational clearance with respect to the respective associated incision 26 of the key 24 whose dimension depends on the angular dimension of the respective incision 26, i.e. in dependence on the angular dimension of the incisions 26, outer edges or side edges of the shaft 25 of the key 24 and corresponding cam sections of the central reception openings 18 of the associated respective disk tumblers 16 come into engagement with one another at different points in time or at different angular positions during sorting.

For example, starting from the zero position of the disk tumblers 16, the total rotational path of the key 24 up to the reaching of the end sorting position of all the disk tumblers 16 amounts to approximately 110°, i.e. after a rotation of the key 24 by approximately 110° all the disk tumblers 16 are sorted and the blocking cut-outs 20 are aligned in radial alignment with the blocking pin 22. A pattern of six different angular positions is typically provided at uniform intervals for the possible angular positions of the blocking cut-outs 20, with the angular spacing between two blocking cut-outs 20 adjacent in the pattern amounting to approximately 18°. Correspondingly, there are six possible encodings for each disk tumbler 16, with the respective disk tumbler 16 having to be rotated by a specific angle out of its zero position for setting one of these encoded positions. In the exemplary disk cylinder 10, an encoding "1" corresponds to a rotation of the disk tumbler 16 by approximately 20°, an adjacent encoding "2" corresponds to a rotation of approximately 38°, etc. and, finally, an encoding "6" corresponds to a rotation of approximately 110°, in each case measured from the zero position up to reaching the end sorting position. The blocking cut-outs 20 are accordingly arranged at an angular spacing from the blocking reception recess 34 of the cylinder housing 12 corresponding to the respective encoding when the disk tumblers 16 are in the zero position.

At the encoding "6", a compulsory coupling between the corresponding disk tumbler 16 and the associated section of the key 24 can be provided, i.e. no incision or an incision having the angular dimension 0° is present so that no rotational clearance is present between the key 24 and the disk tumbler 16.

At the encoding "1", in contrast, there is the largest possible rotational clearance between the key 24 and the disk tumbler 16, i.e. an incision 26 having an angular dimension of approximately 90° is provided at the key 24. A disk tumbler 16 of the encoding "1" is thus generally only taken along at the end of the rotational actuation of the key 24, i.e. after a rotation by approximately 90°, and is brought into its end sorting position by a rotation of the key 24 by a further approximately 20°.

A disk cylinder can also have one or more so-called release disks which are disk tumblers as a rule. Each release disk has the encoding "6" and is arranged at a predefined axial position in the disk housing, e.g. at the very front, at the very rear or at the center of the disk cylinder 10 with respect to the key insertion direction. The disk tumbler acting as a release disk has a compulsory coupling with the key 24. On a key actuation in the unlocked direction, the release disk serves for the coupling of the key 24 with the disk housing 14 on the completion of the sorting (rotation by 110°) and thus effects a rotary entrainment of the disk housing 14. Starting from the release position of the blocking pin 22, the release disk ensures, on a key actuation in the locked direction, that the blocking pin 22 is properly raised out of the blocking cut-outs 20 of the disk tumblers 16 (i.e. are urged into the blocking pin reception recess 34) and are not canted, for instance.

It is furthermore customary to arrange intermediate disks 36 between the disk tumblers 16, said intermediate disks being coupled to the disk housing 14 in a rotationally fixed manner or with rotational clearance. The intermediate disks 36 decouple adjacent disk tumblers 16 from one another so that the rotational movement of the respective disk tumbler 16 does not effect a co-rotation of the disk tumbler 16 adjacent thereto due to friction. Such an entrainment could namely have the result that a disk tumbler 16 is under certain circumstances rotated beyond its unlocked position and the disk cylinder 10 can thus no longer be opened.

The rotationally fixed coupling of the intermediate disks 36 with the disk housing 14 can take place by abutment sections 40 of the intermediate disks 36 which extend at least partly in the radial direction (FIG. 2) and which contact corresponding projections 42 formed at the inner wall of the disk housing 14. Each intermediate disk 36 has a peripheral cutaway 38 which radially aligns with the blocking pin 22. Each intermediate disk 36 accordingly has a further peripheral cutaway 38*a* which radially aligns with the core pin 46 and which is preferably diametrically opposite the peripheral cutaway 38.

Disk cylinders of the above-described kind have proved to be advantageously secure against manipulation. An unauthorized person can nevertheless attempt, using a suitable tool, a so-called picking tool, to probe the individual disk tumblers after one another and hereby to sort them after one another, i.e. to bring them into the respective end sorting position in order subsequently to unlock the disk cylinder. An attempt could furthermore be made to sense the explained encoding of the disk tumblers to simulate a key having suitable incisions. Such picking tools are known in various designs, with these picking tools sharing the feature that their tips are guided along the cylinder axis one after the other through the reception openings of the individual disk tumblers to rotate the respective disk tumbler into its end sorting position.

It is the underlying object of the present invention to provide a key or a key blank that makes possible the design of a disk cylinder having improved protection against manipulations such as picking.

Such a key or a key blank for a disk cylinder having a plurality of rotatably supported disk tumblers has a key shaft having a shaft cross-section (relating to an orthogonal plane to the key axis), with the shaft cross-section having a first end section, a second end section, and a connection section along a longitudinal axis (within the observed section plane), said connection section connecting the first end section to the second end section. The first end section and the second end section of the shaft cross-section comprise a respective encoding region for driving an associated disk tumbler (sorting the disk tumblers after using up a respective rotational clearance, as explained above). The connection section of the shaft cross-section is narrower than the two end sections and has two longitudinal edges that are aligned in parallel with one another and that extend obliquely to the longitudinal axis of the shaft cross-section between the two end sections.

The connection section of the shaft cross-section comprises a central region that has a square shape, wherein the square shape:

- has two exposed edges which are disposed opposite one another and of which each forms a part of one of the two longitudinal edges of the connection section;
- has corners which are disposed diametrically opposite one another and of which each corresponds to a transition of the connection section to the respective end section of the shaft cross-section; and
- two further edges which are disposed opposite one another, which pass through the connection section, and of which each extends from one of said two corners up to the longitudinal edge of the connection section disposed opposite the respective corner.

The shaft cross-section of the key or of the key blank therefore has a first end section and a second end section to provide the required encoding regions that are required to be able rotate the disk tumblers of the disk cylinder into the end sorting position in accordance with the angular dimension of the respective incision. The two end sections of the shaft cross-section are connected to one another via a connection section, with the shaft cross-section hereby being able to have a substantially rectangular base shape (apart from rounded portions and/or lateral cut-outs, as will be explained in the following). The first end section, the connection section, and the second end section are arranged along a longitudinal axis of the shaft cross-section, with the longitudinal axis defining a central plane of the key shaft in a projection along the key axis.

It has been recognized within the framework of the invention that a minimal opening width of the keyway of the disk cylinder that, on the one hand, makes the insertion and the subsequent use of a picking tool more difficult and that, on the other hand, still enables a sufficient driving torque for the proper (i.e. authorized) opening actuation of the disk cylinder and of the associated lock, can be achieved in that the connection section of the shaft cross-section extends obliquely to the longitudinal axis of the shaft cross-section and is led back onto a square shape in a central region.

This square shape is characterized in that a pair of exposed first edges of the square shape that are disposed opposite one another respectively forms a part of the longitudinal edges of the connection section, with a pair of second edges of the square shape that are disposed opposite one another and that pass through the connection section perpendicular to the two longitudinal edges respectively defining two (first) corners of the square shape with one of the first edges of the square shape. These two (first) corners of the square shape are diametrically opposite one another and respectively form a transition of the connection section to one of the two end sections of the shaft cross-section. The two (imaginary) second edges stand perpendicular on the longitudinal edges of the connection section and there define two (second) corners of the square shape that are disposed diametrically opposite one another. The two first corners of the square shape are thus approximately at one end of a respective one of the two longitudinal edges of the connection section of the shaft cross-section while the two second corners of the square shape are arranged approximately in a central region of a respective one of the two longitudinal edges of the connection section.

Due to this special geometry of the shaft cross-section of the key or of the key blank, a connection section between two end sections is defined which is narrowed with respect to the end sections, which is furthermore obliquely aligned with respect to the longitudinal axis of the shaft cross-section, and whose extent along the longitudinal axis of the shaft cross-section is in another respect fixed by the explained square shape of the central region, with two corners of the square shape which are disposed diametrically opposite one another fixing the transition of the connection section to the respective end section of the shaft cross-section.

This special geometry of the shaft cross-section of the key or of the key blank not only allows the cross-sectional surface of the key shaft to be minimized, but a shape is also provided that makes the insertion and use of customary picking tools substantially more difficult or almost precludes said use with respect to customary picking tools having an elongate-rectangular cross-section. It is only required for this purpose that at least one element of the associated disk cylinder, for example one of the disk tumblers or a securing disk located at an insertion opening of the keyway, has a central key opening having a cross-section that is at least substantially shaped in a complementary manner with the shaft cross-section of the key or of the key blank. A picking tool having an elongate-rectangular cross-section can admittedly nevertheless be inserted into the keyway, provided that the rectangular shape of the tip is sufficiently small and is aligned in accordance with the oblique position of the connection section of the shaft cross-section; however, since not all the disks of the disk cylinder have to have the same cross-section of their respective key opening and since in particular some or all of the disk tumblers can have a key reception opening having a different and/or larger cross-section, a rotational clearance relative to the disk tumblers can be implemented for the picking tool that makes the probing of the individual encodings substantially more difficult.

Advantageous embodiments of the invention are named in the following and in the dependent claims and can be seen from the drawings.

Each of the two end sections of the shaft cross-section preferably comprises a first side edge, a second side edge that is disposed opposite the first side edge, an outer edge, and an inner edge that is disposed opposite the outer edge and that extends, starting from the first side edge, to one of said two (first) corners of the square shape of the connection section. An end of each of the two longitudinal edges of the connection section leads to an end of the inner edge of a respective one of the two end sections of the shaft cross-section to form the respective (first) corner of the square shape. Another end of each of the two longitudinal edges of the connection section furthermore leads to the second side edge of the respective other end section of the shaft cross-section. A "Z" shape of the shaft cross-section is hereby formed. The outer edge of the respective end section can be provided at a respective end face of the shaft cross-section in extension of the longitudinal axis and/or can at least partly bound the encoding region of the respective end section.

In accordance with an embodiment, the first side edge and the second side edge of each of the two end sections of the shaft cross-section are at least substantially aligned in parallel with one another. Alternatively or additionally, the first side edge and the second edge can be formed in a straight line.

In accordance with a further embodiment, the outer edge of each of the two end sections of the shaft cross-section has the shape of a circular section. The key shaft can hereby be guided in a shape-matched manner along the outer edge during a rotational movement in the associated keyway.

In accordance with a further embodiment, the inner edges of the two end sections of the shaft cross-section are aligned at least substantially perpendicular to the longitudinal axis of the shaft cross-section. Alternatively or additionally, the inner edges of the two end sections can be formed in a straight line.

In accordance with a preferred embodiment, the shaft cross-section can have a respective cut-out at the level of the connection section, the cut-out at least substantially having a triangular shape—with respect to a rectangular base shape of the shaft cross-section—with a first limb of the respective triangular shape forming the inner edge of one of the two end sections of the shaft cross-section, and with a second limb of the respective triangular shape forming one of the two longitudinal edges of the connection section. The two triangles can be offset relative to one another along the longitudinal axis of the shaft cross-section, i.e. with the same size, the corresponding cut-outs do not necessarily have to be at the same level along the longitudinal axis of the shaft cross-section.

The longitudinal edges of the connection section of the shaft cross-section can also be formed in a straight line in accordance with a preferred embodiment.

As regards the two (first) corners of the square shape of the connection section which form a transition of the connection section to the respective end section of the shaft cross-section, these corners of the square shape of the connection section or the transitions between the connection and the respective end section of the shaft cross-section hereby formed can be rounded to simplify the production of the key shaft and to reduced notch stresses. The position of the corners of the square shape at the shaft cross-section is nevertheless defined by an imaginary extension of the respective edge of the square shape.

It is preferred with respect to said oblique alignment of the connection section relative to the longitudinal axis of the shaft cross-section and accordingly with respect to the oblique alignment of said square shape of the connection section relative to the longitudinal axis of the shaft cross-section if an angle is provided for the oblique alignment in a range from approximately 22° to 32° (inclusive in each case) (for example approximately 27°). A particularly suitable ratio of the width of the (narrow, but obliquely standing) connection section to the (total) width of the shaft cross-section and also a suitable spacing of the two end sections of the shaft cross-section from one another can be achieved by such an oblique position.

In accordance with a further embodiment, the respective transition of the connection section to the respective end section of the shaft cross-section can be set back (i.e. displaced in the direction of a central plane)—starting from the associated broad side of the shaft cross-section—by a value that amounts to approximately 40% of the width of the shaft cross-section. An advantageously narrow connection section hereby results that is, however, still connected to the respective end section of the shaft cross-section in a sufficiently stable manner.

Furthermore, in accordance with an advantageous embodiment, provision can be made that the mutual spacing of the two longitudinal edges of the connection section of the shaft cross-section amounts to a value in the range from 37% to 47% (respectively inclusive), in particular 40% up to 44% of the (total) width of the shaft cross-section.

In accordance with a further aspect, the invention also relates to a key or a key blank for a disk cylinder having a plurality of rotatably supported disk tumblers, wherein the key or the key blank has a key shaft having a shaft cross-section that has a first end section, a second end section, and a connection section along a longitudinal axis, said connection section connecting the first end section and the second end section to one another, wherein the first end section and the second end section have a respective encoding region for driving an associated disk tumbler, wherein the connection section of the shaft cross-section is narrower than the two end sections and has two longitudinal edges that are aligned in parallel with one another and that extend obliquely to the longitudinal axis of the shaft cross-section between the two end sections, and wherein the mutual spacing of the two longitudinal edges of the connection section amounts to a value in the range from 37% to 47%, in particular approximately 40% to 44%, of the width of the shaft cross-section. A minimal opening width of the keyway of the disk cylinder can also hereby be achieved without forming a square shape in a central region of the connection section, said minimal opening making the insertion and the subsequent use of a picking tool more difficult, on the one hand, and still enabling a sufficient driving torque for the intended (i.e. authorized) opening actuation of the disk cylinder and of the associated lock, on the other hand. It is also preferred in this further invention aspect with respect to the oblique alignment of the (narrow) connection section relative to the longitudinal axis of the shaft cross-section if an angle is provided for the oblique alignment in a range from approximately 22° to 32° (exclusively in each case) (for example approximately 27°). A particularly suitable ratio of the width of the (narrow, but obliquely standing) connection section to the (total) width of the shaft cross-section and also a suitable spacing of the two end sections of the shaft cross-section from one another can be achieved by such an oblique position.

Provision can be made for all of the aforesaid invention aspects that, viewed along the longitudinal axis of the shaft cross-section, the first end section, the connection section, and the second end section of the shaft cross-section extend in each case approximately along a third of the length or height of the shaft cross-section. A good stability for transmitting sufficient driving torques can hereby be achieved with a minimal cross-section surface of the connection section.

The width of the shaft cross-section can amount to approximately 45% of the height of the shaft cross-section.

The shaft cross-section is preferably point-symmetric so that the key or a key produced from the key blank can be used as a so-called reversible key in two rotational positions displaced by 180° with respect to one another.

As regards the encoding regions of the two end sections of the shaft cross-section, they are preferably provided at a respective end face of the shaft cross-section in extension of the obliquely extending connection section. In other words, the encoding regions (for the driving of the disk tumblers in the direction of rotation) should be arranged substantially in alignment with the elongate, but obliquely extending connection section. Particularly high driving torques can hereby be transmitted with respect to the direction of rotation for sorting the disk tumblers and thus for opening the lock associated with the disk cylinder since the reaction force exerted on the shaft cross-section is taken up along the longitudinal direction of the cross-section, i.e. the force transmission at least substantially takes place in the longitudinal direction of the connection and not in the transverse direction, for instance.

The key shaft can have at least one incision at the respective encoding region of the two end sections of the shaft cross-section, said incision extending at an angle to the longitudinal axis of the shaft cross-section that has a value in the range from 0° to 90° (inclusive in each case). The respective incision can in particular be formed at the already named outer edge and/or side edge of the respective end section of the shaft cross-section.

The invention also relates to a disk cylinder of the explained kind, i.e. having a cylinder housing, a rotatable disk housing, a blocking pin, and a plurality of disk tumblers, and having a key or a key blank of the explained kind, i.e. that has a key shaft having a shaft cross-section that has a first end section, a second end section, and a connection section along the longitudinal axis, with the connection section comprising a central region that has a square shape.

The key reception openings of the disk tumblers can form a keyway extending along the cylinder axis, with the disk cylinder, in accordance with an advantageous embodiment, having at least one securing disk at an insertion opening of the keyway, said securing disk having a key insertion opening having a cross-section that is shaped at least substantially in a complementary manner to the shaft cross-section of the key or of the key blank. A cross-section constriction that makes the insertion of a picking tool more difficult is hereby provided at or close to the key insertion opening of the disk cylinder.

It is possible in this embodiment that the key reception openings of the disk tumblers (in particular of all the disk tumblers) have a cross-section that has a different shape than the cross-section of the key insertion opening of the securing disk and that can, for example, at least substantially have the shape of a rectangle. The respective cross-section of the key reception openings of the disk tumblers can in particular be larger at least regionally than the cross-section of the key insertion opening of the securing disk. The explained probing of the individual disk tumblers can hereby be made more difficult since the picking tool has to be relatively small, on the one hand, for the penetration of the securing disk and has to overcome a rotational clearance, on the other hand, for the probing or sorting of the disk tumblers.

It is, however, not absolutely necessary that the cross-section of the respective key reception opening of all the disk tumblers has a different cross-section, and in particular a larger cross-section, than said cross-section of the key insertion opening of the securing disk. Provision can rather also be made that (alternatively or additionally to said securing disk) one or more or all the disk tumblers has/have a respective key reception opening having a cross-section that is shaped at least substantially in a complementary manner to the shaft cross-section of the key or of the key blank. It can in particular be sufficient if the key reception opening of only one single (preferably central) disk tumbler has a cross-section that is shaped at least substantially in a complementary manner to the shaft cross-section of the key or of the key blank, while all the other disk tumblers or even all the other rotatably supported disks of the disk cylinder have a differently shaped cross-section and in particular a rectangular cross-section of the respective key opening.

The invention will be described in the following by way of example with reference to the drawings, in which the same or similar elements are characterized by the same reference numerals.

Figure 2:
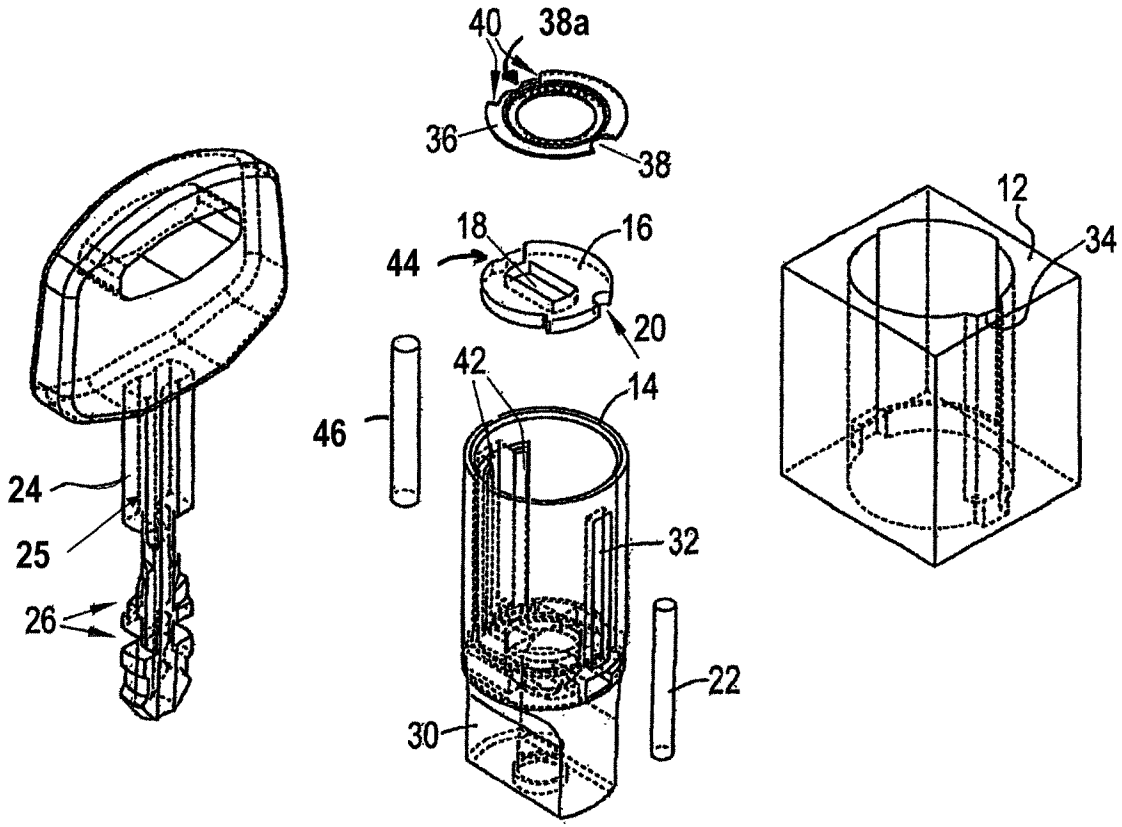
PRIOR ART Fig. 2
FIG. 2 shows an exploded view of parts of the disk cylinder with a key in accordance with FIG. 1.
Figure 3:
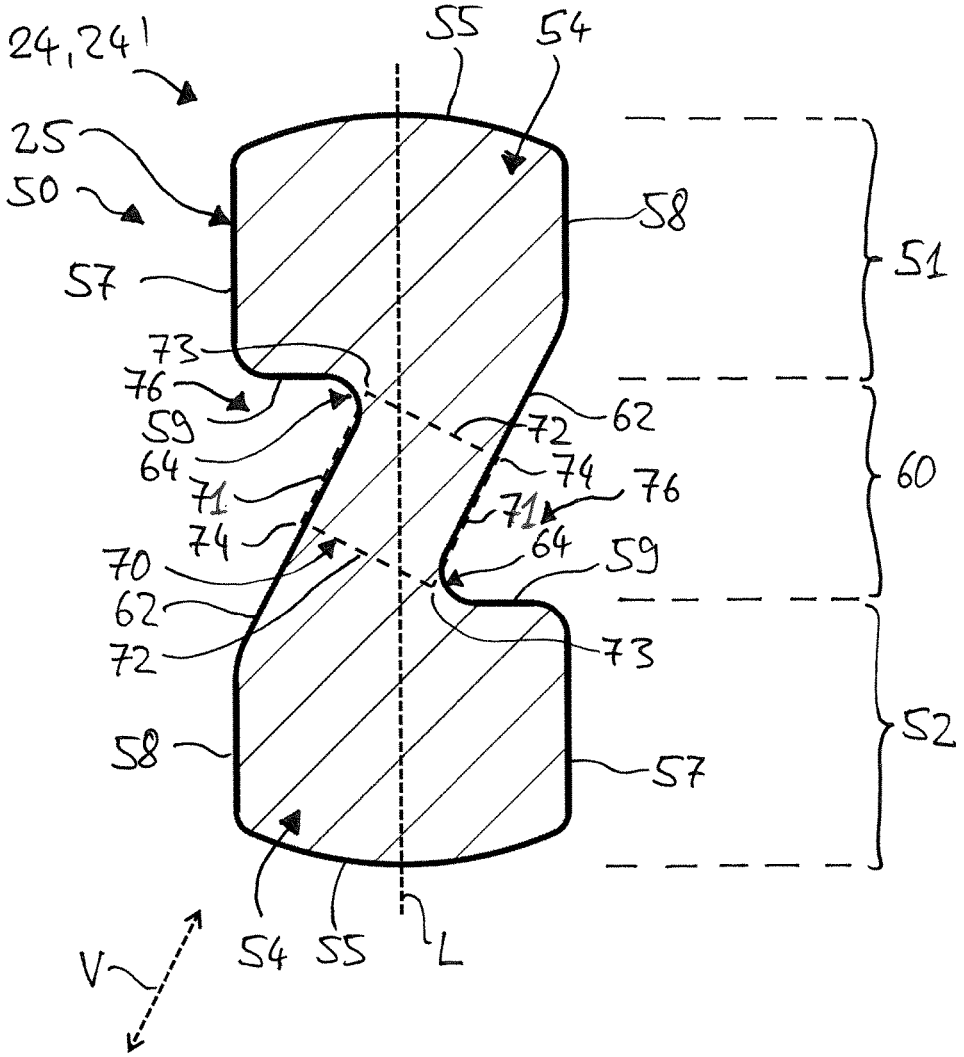
FIG. 3 shows a shaft cross-section of a key with an encoding "6" or of a key blank.

FIG. 3 shows a cross-section 50 of the key shaft 25 of a key 24 for a disk cylinder 10 in accordance with FIGS. 1 and 2 and a cross-section 50 of a key blank 24' that serves for the manufacture of a key 24, wherein the shaft cross-section 50 in accordance with FIG. 3 differs from the shaft cross-section of a key 24 in accordance with FIGS. 1 and 2, as will be explained in the following. The view in accordance with FIG. 3 is selected such that the key 24 is rotated clockwise for an opening actuation of the associated disk cylinder.

The shaft cross-section 50 in the embodiment shown here is point-symmetric and has a first end section 51, a second end section 52, and a connection section 60 along a longitudinal axis L (extending within the shown section plane), said connection section connecting the first end section 51 and the second section 52 to one another. The first end section 51, the second end section 52 and the connection section 60 extend in each case along approximately a third of the length of the shaft cross-section 50 with respect to the longitudinal axis L in the embodiment shown in FIG. 3.

Figure 4:
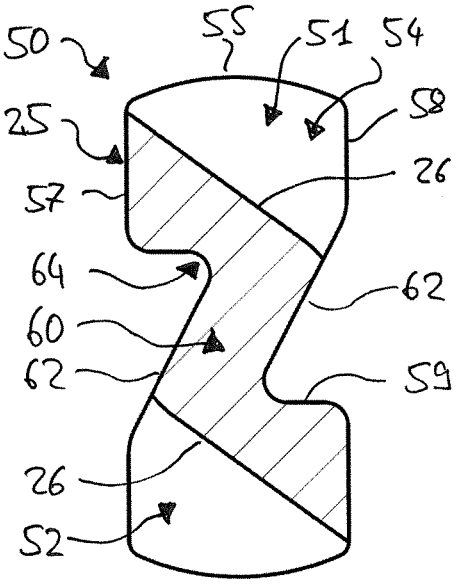
FIG. 4 shows a shaft cross-section of a key with an encoding "3"
Figure 5:
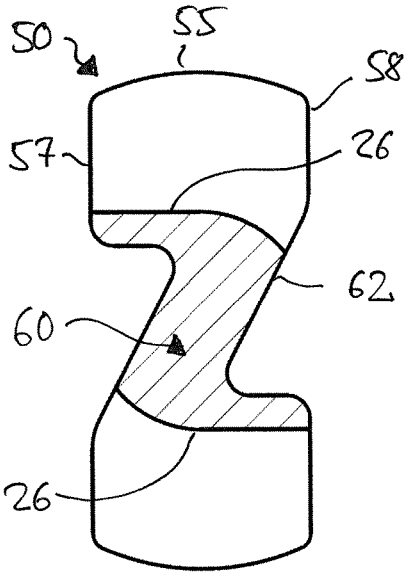
FIG. 5 shows a shaft cross-section of a key with an encoding "1"

The first end section 51 and the second end section 52 form, in extension of the obliquely extending connection section 60, a respective encoding region 54 for driving an associated disk tumbler 16 (FIGS. 1 and 2), with a respective outer edge 55 of the end section 51, 52 partly bounding the respective encoding region 54 and being able to be set back, however, partly or completely by an incision 26 (FIGS. 1 and 2), as is shown in FIGS. 4 and 5. The shaft cross-section 50 in accordance with FIG. 3, however, has no incision and thus corresponds to an encoding "6" or to a key blank without incisions.

The connection section 60 of the shaft cross-section 50 is narrower than the two end sections 51, 52 and has two rectilinear longitudinal edges 62 that are in parallel with one another and that extend between the two end sections 51, 52 along a direction of extent V at an able of, for example, approximately 27° or approximately 31° obliquely to the longitudinal axis L of the shaft cross-section 50. The mutual spacing of the two longitudinal edges 62 of the connection section 60 amounts in the embodiment shown in FIG. 3 to approximately 40% of the width (measured perpendicular to the longitudinal axis L) of the shaft cross-section 50.

The connection section 60 of the shaft cross-section 50 comprises a central region having the shape 70 of a square that is rotated relative to the longitudinal axis L in accordance with the oblique extent of the connection section 60. The square shape 70 comprises two exposed first edges 71 which are disposed opposite one another and of which each forms a part of one of the two longitudinal edges 62 of the connection section 60 and two second edges 72 disposed opposite one another and passing through the connection section 60. The two second edges 72 have the same length as the two first edges 71 and are aligned orthogonally thereto.

The square shape 70 furthermore comprises two first corners 73 which are disposed diametrically opposite one another and of which each corresponds to a transition 64 of the connection section 60 to the respective end section 51 and 52 respectively of the shaft cross-section 50, with the respective transition 64 being rounded so that the first corners 73 of the (imaginary) square shape 70 do not exactly coincide with the actual (i.e. physical) negative corners that are formed by the respective transition 64. The two first corners 73 of the square shape 70 are thus located approximately at one end of a respective one of the two longitudinal edges 62 of the connection section 60 of the shaft cross-section 50.

The square shape 70 furthermore comprises two second corners 74 that are disposed diametrically opposite one another and that are approximately arranged in a central region of a respective one of the two longitudinal edges 62 of the connection section 60. Each of the two first edges 71 thus extends from one of the two first corners 73 along an associated longitudinal edge 62 up to one of the two second corners 74. Each of the two second edges 72 extends from one of the two first corners 73 transversely to the connection section 60 and in particular orthogonally to the direction of extent V up to one of the two second corners 74.

Each of the two end sections 51, 52 of the shaft cross-section 50 comprises a first side edge 57 and a second side edge 58 that is disposed opposite the first side edge 57 with respect to the (central) longitudinal axis L, with the first side edge 57 and the second side edge 58, in the embodiment shown here, being aligned in parallel with one another and being rectilinear. The two side edges 57, 58 are of different length. Each of the two end sections 51, 52 of the shaft cross-section 50 furthermore comprises the already named outer edge 55 that has the shape of a circular section in the embodiment shown here and an inner edge 59 that is disposed opposite the outer edge 55 and that extends, starting from the first side edge 57, in the direction of the (central) longitudinal axis L to one of the two first corners 73 of the square shape 70 of the connection section 60. The respective inner edge 59 can in particular extend, as shown in FIG. 3, orthogonally to the longitudinal axis L of the shaft cross-section 50. This is, however, not absolutely necessary; for example, the respective inner edge 59 could be inclined with respect to such an orthogonal alignment, in particular in a similar manner to or corresponding to the alignment of the second edges 72 of the square shape 70.

Corresponding to the explained oblique position of the connection section 60 and to the square shape 70, the two longitudinal edges 62 of the connection section 60 merge into the respective end section 51, 52 of the shaft cross-section 50 at different heights (with respect to the longitudinal axis L). One end of each of the two longitudinal edges 62 leads to an end of the inner edge 59 of the respective end section 51, 52 to form the respective transition 64. The respective transition 64 of the connection section 60 to the respective end section 51, 52 of the shaft cross-section 50 is set back in the embodiment shown here by a value of approximately 40% of the width (measured perpendicular to the longitudinal axis L) of the shaft cross-section 50. The other end of each of the two longitudinal edges 62 furthermore leads to the second side edge 58 of the respective other end section 52 or 51 respectively of the shaft cross-section 50.

To form, starting from an at least substantially rectangular base shape, the shaft cross-section 50 with an obliquely extending connection section 60 in accordance with FIG. 3, the shaft cross-section 50 has a respective cut-out 76 that at least substantially has a triangular shape at the height of the connection section 60 at both longitudinal sides, with a first limb of the respective triangular shape forming the inner edge 59 of one of the two end sections 51, 52 of the shaft cross-section 50, and with a second limb of the respective triangular shape forming one of the two longitudinal edges 62 of the connection section 60.

FIG. 4 shows a shaft cross-section 50 of a key 24 corresponding to FIG. 3, but at a point along the key axis S at which an incision 26 is provided that represents the encoding "3" in accordance with the initially explained encoding system. The incision 26 introduced at the outer edge 55, at the second side edge 58, and partly at the longitudinal edge 62 of the connection section 60 adjacent thereto is accordingly inclined by an angle of approximately 36° with respect to the longitudinal axis L (FIG. 3).

FIG. 5 shows a corresponding shaft cross-section 50 of a key 24 at a point along the key axis S at which an incision 26 is provided that represents the encoding "1" in accordance with the initially explained encoding system. The incision 26 introduced at the outer edge 55, at the first side edge 57, at the second side edge 58, and partly at the longitudinal edge 62 of the connection section 60 adjacent thereto is accordingly inclined by an angle of approximately 90° with respect to the longitudinal axis L (FIG. 3).

Figure 1:
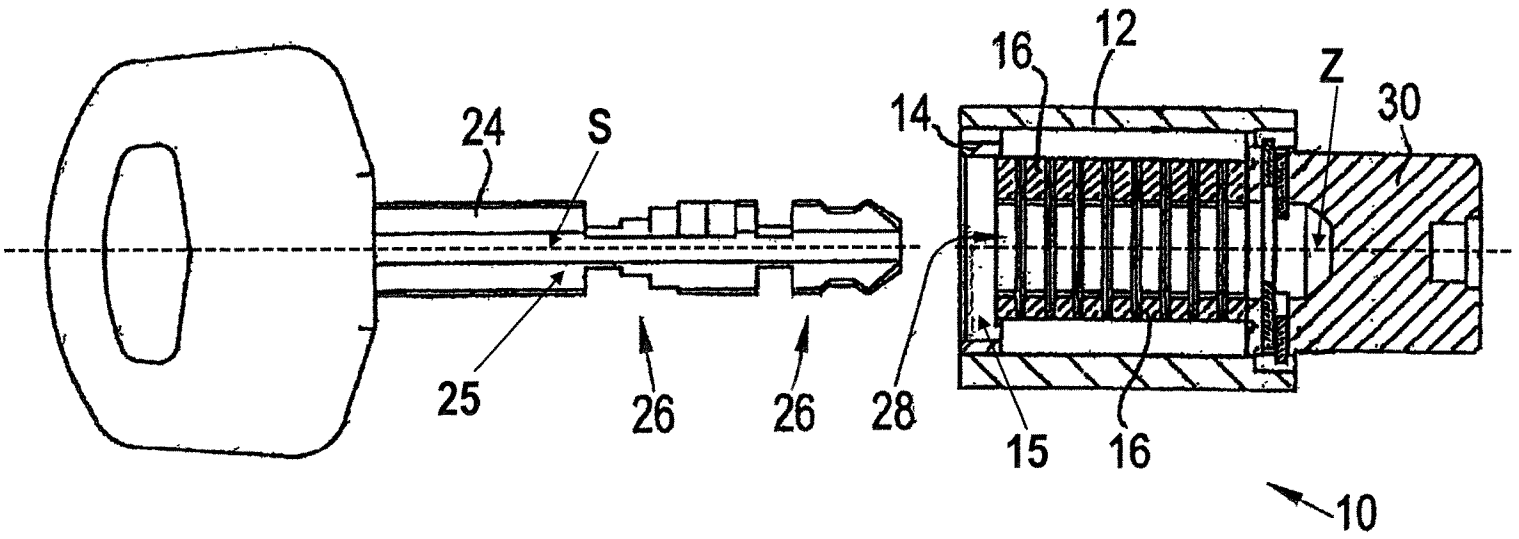
PRIOR ART Fig. 1
FIG. 1 shows a longitudinal section of a disk cylinder with a key.

The special geometry of the shaft cross-section 50 in accordance with FIGS. 3 to 5 allows a minimal opening width of the keyway 28 (FIG. 1) of the disk cylinder (10) that, on the one hand, makes the insertion and the subsequent use of a picking tool more difficult and that, on the other hand, still enables a sufficient driving torque for the proper opening actuation of the disk cylinder 10 for driving the coupling section 30 (FIG. 1). Due to the configuration of the connection section 60, that is narrow and extends obliquely such that a correspondingly obliquely standing square shape 70 is formed between the two end sections 51, 52 (required for the driving of the disk tumblers 16) of the shaft cross-section 50, the cross-sectional surface of the key shaft 25 is minimized, whereby the insertion and use of conventional picking tools is made substantially more difficult or is practically precluded (with respect to conventional picking tools having an elongate-rectangular cross-section).

A sufficiently high driving torque can nevertheless be applied to the disk tumblers 16 since the respective encoding region 54 of the end sections 51, 52 is provided in extension of the obliquely aligned connection section 60, whereby the reaction forces occurring at the key shaft 25 can be taken up and distributed along the direction of extent V of the connection section 60. This can be recognized particularly easily with reference to FIG. 4 (encoding "3"). When, on a clockwise rotational movement of the key shaft 25, the incision 26 acts on a disk tumbler 16 (FIGS. 1 and 2) and drives the coupling section 30 via it, the reaction force of the square shape 70 (FIG. 3) of the connection section 60 is taken up and supported.

Figure 6:
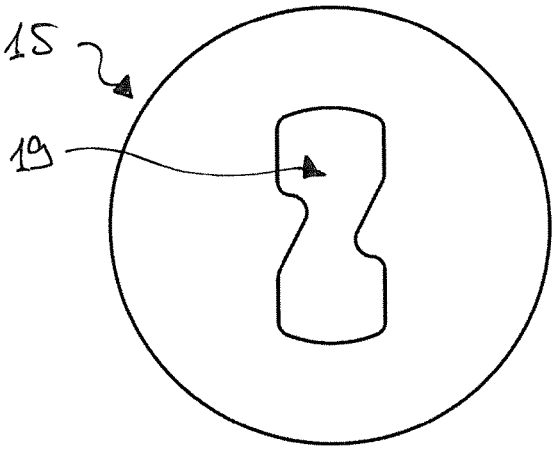
FIG. 6 shows a securing disk of a disk cylinder.

FIG. 6 shows a securing disk 15 that is provided at an insertion opening of the keyway 28 of a disk cylinder 10 (FIGS. 1 and 2). The securing disk 15 has a central key insertion opening 19 having a cross-section that is formed at least substantially in a complementary manner to the shaft cross-section 50 of the key 24 (encoding "6" in accordance with FIG. 3) or of the key blank 24'. To facilitate the insertion of the key 24 into the keyway 28 of the disk cylinder 10, the cross-section of the key insertion opening 19 can be somewhat larger and much more rounded than the shaft cross-section 50. The opening width of the keyway 28 of the disk cylinder 10 is bounded by such a securing disk 15 to make the insertion of a picking tool more difficult, as explained.

Alternatively or additionally, one or more disk tumblers 16 or other disks of the disk cylinder 10 (e.g. release disk) can also have a reception opening 18 whose cross-section is formed at least substantially in a complementary manner to the shaft cross-section 50 of the key 24 or of the key blank 24'.

REFERENCE NUMERAL LIST

10 disk cylinder
12 cylinder housing
14 disk housing
15 securing disk
16 disk tumbler
18 reception opening
19 key insertion opening
20 blocking cut-out
22 blocking pin
24 key
24' key blank
25 key shaft
26 insertion
28 keyway
30 coupling section
32 slit
34 blocking pin reception recess
36 intermediate disk
38, 38*a* peripheral cut-out
40 abutment section
42 projection
44 fixing cut-out
46 core pin
50 shaft cross-section
51 first end section
52 second end section
54 encoding region
55 outer edge
57 first side edge
58 second side edge
59 inner edge
60 connection section
62 longitudinal edge of the connection section
64 transition between the connection section and the end section
70 square shape
71 first edge of the square shape
72 second edge of the square shape
73 first corner of the square shape
74 second corner of the square shape
76 cut-out L longitudinal axis of the shaft cross-section
S key axis
V direction of extent of the connection section
Z cylinder axis

The invention claimed is:

1. A disk cylinder having a key, comprising:

a cylinder housing;

a disk housing rotatably supported about a cylinder axis in the cylinder housing;

at least one blocking pin which is provided at the outer periphery of the disk housing, which is aligned in parallel with the cylinder axis and is displaceable radially to the cylinder axis, which blocks the disk housing against a rotational movement in a radially outer blocking position, and which releases the disk housing for a rotational movement in a radially inner release position; and a plurality of disk tumblers arranged along the cylinder axis in the disk housing and rotatably supported between a locked position and an unlocked position, with each disk tumbler having a key reception opening and, at the outer periphery, at least one cut-out in which the blocking pin is at least partly receivable in the release position, with the blocking pin only being displaceable into the release position when all the disk tumblers are in their unlocked positions in which the cut-out of the respective disk tumbler is aligned radially to the blocking pin, wherein the key has a key shaft having a shaft cross-section that has a first end section, a second end section, and a connection section along a longitudinal axis, said connection section connecting the first end section and the second end section to one another, with the first end section and the second end section having a respective encoding region for driving an associated disk tumbler;

wherein the connection section of the shaft cross-section is narrower than the two end sections and has two longitudinal edges that are aligned in parallel with one another and that extend between the two end sections obliquely to the longitudinal axis of the shaft cross-section;

and wherein the connection section of the shaft cross-section comprises a central region that has a square shape, with the square shape:

having two exposed edges which are disposed opposite one another and of which each forms a part of one of the two longitudinal edges of the connection section;

having two corners which are disposed diametrically opposite one another and of which each corresponds to a transition of the connection section to the respective end section of the shaft cross-section; and having two further edges which are disposed opposite one another, which pass through the connection section, and of which each extends from one of said two corners up to the longitudinal edge of the connection section disposed opposite the respective corner, wherein the key shaft has at least one incision at the respective encoding region of the two end sections of the cross-section, wherein said at least one incision extends across the entire width of the shaft cross-section.

2. The disk cylinder in accordance with claim 1, wherein each of the two end sections of the shaft cross-section has a first side edge, a second side edge that is disposed opposite the first side edge, an outer edge, and an inner edge that is disposed opposite the outer edge and that extends, starting from the first side edge, to one of said two corners of the square shape of the connection section;

wherein one end of each of the two longitudinal edges of the connection section leads to an end of the inner edge of a respective one of the two end sections of the shaft cross-section to form said respective corner of the square shape; and wherein another end of each of the two longitudinal edges of the connection section leads to the second side edge of the respective other end section of the shaft cross-section.

3. The disk cylinder in accordance with claim 2, wherein the first side edge and the second side edge of each of the two end sections of the shaft cross-section are aligned at least substantially in parallel with one another and/or are rectilinear.

4. The disk cylinder in accordance with claim 2, wherein the outer edge of each of the two end sections of the shaft cross-section has the shape of a circular section.

5. The disk cylinder in accordance with claim 2, wherein the inner edges of the two end sections of the shaft cross-section are at least substantially aligned perpendicular to the longitudinal axis of the shaft cross-section and/or are rectilinear.

6. The disk cylinder in accordance with claim 2, wherein the shaft cross-section has a respective cut-out at the level of the connection section, said cut-out at least substantially having a triangular shape, with a first limb of the respective triangular shape forming the inner edge of one of the two end sections of the shaft cross-section, and with a second limb of the respective triangular shape forming one of the two longitudinal edges of the connection section.

7. The disk cylinder in accordance with claim 1, wherein the longitudinal edges of the connection section are rectilinear.

8. The disk cylinder in accordance with claim 1, wherein the transitions of the connection section to the respective end section of the shaft cross-section which correspond to said two corners of the square shape are rounded.

9. The disk cylinder in accordance with claim 1, wherein the square shape of the connection section is rotated relative to the longitudinal axis of the shaft cross-section by an angle that has a value in the range from 22° to 32°.

10. The disk cylinder in accordance with claim 1, wherein said respective transition of the connection section to the respective end section of the shaft cross-section is set back with respect to a side edge of the respective end section by a value of approximately 40% of the maximum width of the shaft cross-section.

11. The disk cylinder in accordance with claim 1, wherein a mutual spacing of the two longitudinal edges of the connection section of the shaft cross-section amounts to a value in the range from 37% to 47% of the maximum width of the shaft cross-section.

12. The disk cylinder in accordance with claim 1, wherein the first end section, the connection section and the second end section of the shaft cross-section each extend along approximately a third of the length of the shaft cross-section with respect to the longitudinal axis of the shaft cross-section.

13. The disk cylinder in accordance with claim 1, wherein the shaft cross-section is point symmetric.

14. The disk cylinder in accordance with claim 1, wherein the respective encoding region of the two end sections of the shaft cross-section is provided at a respective end face of the shaft cross-section in alignment, when viewed along connection section.

15. The disk cylinder in accordance with claim 1, wherein the key shaft has at least one incision at the respective encoding region of the two end sections of the shaft cross-section, said incision extending at an angle to the longitudinal axis that has a value in the range from 0° to 90°.

16. The disk cylinder in accordance with claim 1, wherein the key reception openings of the disk tumblers form a keyway extending along the cylinder axis, with the disk cylinder having at least one securing disk at an insertion opening of the keyway, said at least one securing disk having a key insertion opening having a cross-section that is formed at least substantially in a complementary manner to the shaft cross-section of the key.

17. The disk cylinder in accordance with claim 1, wherein at least one of the plurality of disk tumblers has a key reception opening having a cross-section that is formed at least substantially in a complementary manner to the shaft cross-section of the key.

18. The disk cylinder in accordance with claim 2, wherein the key shaft includes first and second incisions that extend in different angular orientations, each angle orientation starting from the second side edge of the respective end section.

* * * * *